United States Patent [19]

McMillin et al.

[11] 4,143,793

[45] Mar. 13, 1979

[54] APPARATUS AND METHOD FOR DISPENSING A CARBONATED BEVERAGE

[75] Inventors: John R. McMillin, Maplewood, Minn.; Peter Strandwitz, Neenah, Wis.

[73] Assignee: The Cornelius Company, Minneapolis, Minn.

[21] Appl. No.: 806,136

[22] Filed: Jun. 13, 1977

[51] Int. Cl.[2] ..... B67D 5/08

[52] U.S. Cl. ..... 222/1; 222/61; 222/64; 222/396; 222/399

[58] Field of Search ..... 222/1, 61, 64–69, 222/129, 394, 396, 397, 399

[56] References Cited

U.S. PATENT DOCUMENTS

| | | | |
|---|---|---|---|
| 2,860,819 | 11/1958 | Ledingham | 222/68 |
| 3,478,929 | 11/1969 | Cornelius | 222/397 X |
| 3,495,612 | 2/1970 | Moreland et al. | 222/394 X |
| 3,578,214 | 5/1971 | Iannelli | 222/394 X |
| 3,790,039 | 2/1974 | Zucconi | 222/394 |
| 3,804,299 | 4/1974 | Kain | 222/61 |
| 3,876,107 | 4/1975 | Meindl et al. | 222/64 |
| 3,878,970 | 4/1975 | Nezworski | 222/61 |
| 3,924,780 | 12/1975 | Elsworth | 222/64 |

FOREIGN PATENT DOCUMENTS

| | | | |
|---|---|---|---|
| 448514 | 6/1936 | United Kingdom | 222/61 |
| 888513 | 1/1962 | United Kingdom | 222/61 |

OTHER PUBLICATIONS

The Distillers Co.; "Automatic Keg Changer", 1–74, London, England.

*Primary Examiner*—Joseph J. Rolla
*Attorney, Agent, or Firm*—Henry C. Kovar

[57] ABSTRACT

Apparatus for dispensing a carbonated beverage including a source of propellant gas, a reservoir for beverage to be dispensed, one or more dispensing valves connected to the reservoir, a propellant gas conduit for applying a first gaseous propellant pressure upon beverage supply vessels and for applying a second and lesser gaseous propellant pressure upon beverage in the reservoir, a beverage supply conduit for transferring beverage from a supply vessel to this reservoir and normally closed valves in the beverage supply and gas conduits, which valves are controllable by a level sensor in the reservoir; the apparatus also features structure for automatically switching from one supply vessel to another as vessels become emptied; a method of dispensing includes the steps of providing a supply of carbonated beverage, applying a first propellant pressure upon the supply, selectively transferring beverage from the supply to a reservoir, applying a second and lesser propellant pressure upon the reservoir and dispensing from the reservoir; there is also a step of automatically switching supply vessels as they become empty.

25 Claims, 2 Drawing Figures

APPARATUS AND METHOD FOR DISPENSING A CARBONATED BEVERAGE

BACKGROUND OF THE INVENTION

1. Field of the Invention

Figure 1:
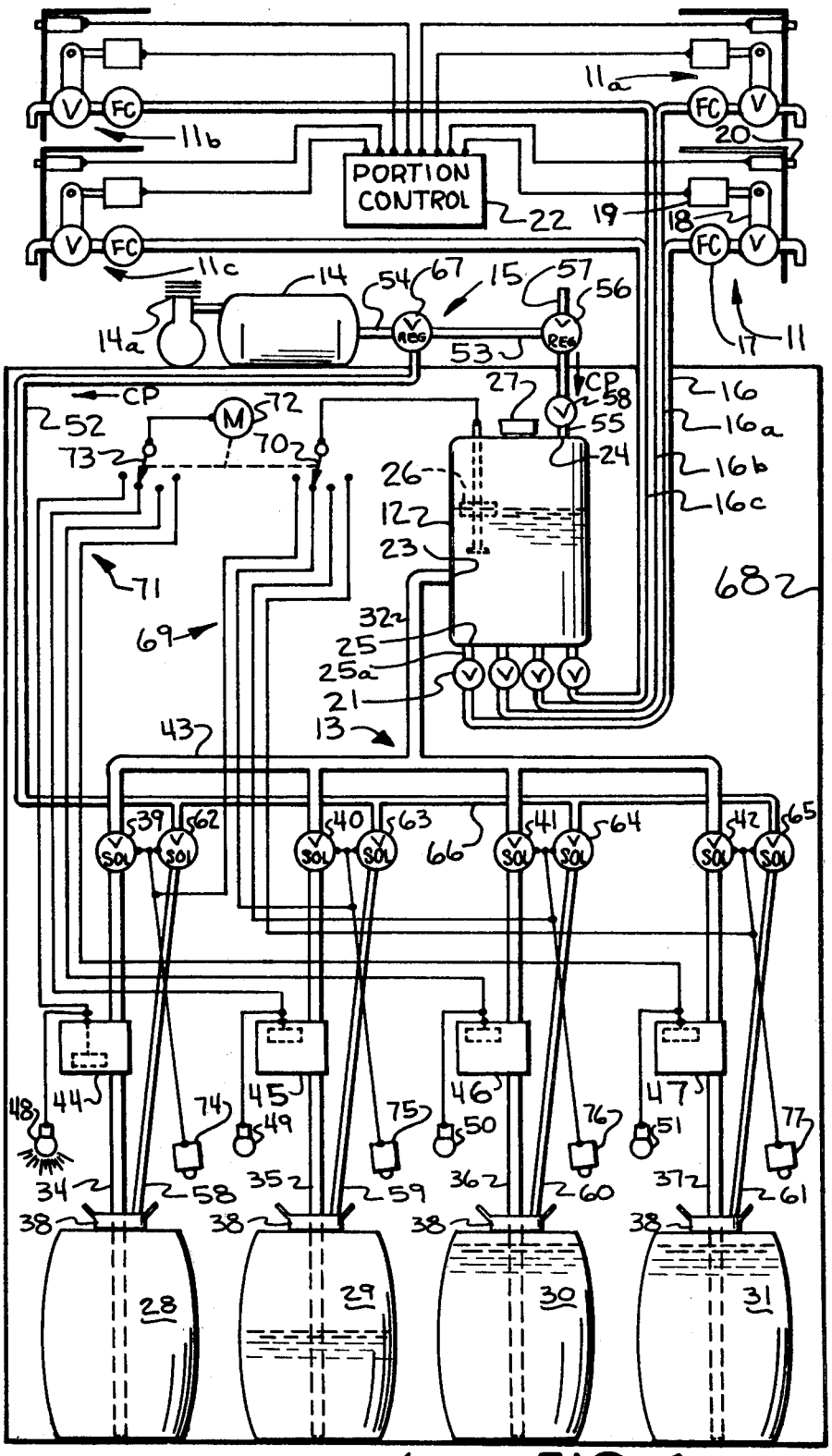

This invention pertains to a beverage dispenser having a reservoir from which beverage is dispensed and an apparatus for supplying beverage to the reservoir; the invention also pertains to a method of dispensing a beverage from a reservoir which includes applying air pressure upon a supply for the reservoir as well as the reservoir and to a method of dispensing including switching of beverage supplies.

2. The Prior Art

The prior art dispensing devices pertinent hereto suffer many operational problems. The worst of these problems is that a dispenser runs out of beverage and has to be closed down while the operator replaces a beverage supply vessel, specifically a beer keg. It has been prior practice to try and solve this problem by hooking a plurality of beer barrels together in series and dispensing from a single dispensing valve connected to the series of barrels. In practice, the pressure drop through the barrels is responsible for decarbonation and foaming at the valve, only a single dispensing valve can be used and only two or so beer barrels can be hooked in series. Further, this attempt requires changing of empty barrels and the entire dispensing system has to be shut down and depressurized in order to change barrels. When the system is refilled and hooked up, quite a bit of foam usually has to be drawn out before clear beer can be dispensed.

If a retailer wants 3, 4, 5, 6 or more beer taps, he has had to have one complete system for each tap or else a system for each two adjacently located taps.

Two dispensing valves are about all that can be connected to a single barrel or series of barrels; if more valves are used and these valves are opened simultaneously, the beer will usually foam in the tap rod due to excessive pressure drop.

As a consequence of these prior devices and methods, taverns and bars are set up with a plurality of individual dispensing systems, and yet, even with these, capacity and the problem of running out of beer is still prevalent.

OBJECTS OF THE PRESENT INVENTION

Accordingly, it is an object of the present invention to provide a beverage dispensing apparatus using compressed air for propelling beverage.

It is an object of the present invention to provide a single beverage dispensing apparatus having many dispensing valves which may all be operated simultaneously.

It is an object of the present invention to provide a dispensing apparatus for carbonated beverage which uses a gaseous propellant pressure in excess of the carbonation saturation pressure of the beverage.

It is an object of the present invention to provide a single beverage dispensing apparatus which will automatically switch beverage supply vessels as they become empty.

It is an object of the present invention to provide a carbonated beverage dispensing apparatus having a portion control, with the apparatus being able to repetitively dispense a most precise, predetermined quantity of beverage.

It is an object of the present invention to provide a method of dispensing a carbonated beverage using gaseous propellant pressure in excess of the carbonation pressure of the beverage.

It is an object of the present invention to provide a method of dispensing a carbonated beverage in which beverage is transferred from bulk supply to a reservoir quantity from which the beverage may be dispensed.

It is an object of the present invention to provide a method of dispensing a carbonated beverage selectively from a plurality of bulk supply vessels.

It is an object of the present invention to provide a method of dispensing a carbonated beverage including automatic switching from one bulk supply vessel to another as the vessels become emptied of beverage.

Many other advantages, features and additional objects of the present invention will become manifest to those versed in the art upon making reference to the detailed description and accompanying drawings in which the preferred embodiment incorporating the principles of the present invention is set forth and shown by way of illustrative example.

SUMMARY OF THE INVENTION

In accordance with the principles of this invention, a beverage dispensing apparatus has a beverage reservoir, one or more dispensing valves for dispensing beverage from the reservoir, a beverage supply conduit for transferring beverage from a supply vessel to the reservoir, and a propellant gas conduit having a first branch line for pressuring a supply vessel and a second branch line for pressuring the reservoir; there are normally closed valves in both the beverage and gas conduits which are under the control of a reservoir beverage level sensor, and there is circuitry for switching from one supply to another; a method of dispensing a beverage includes the steps of selectively transferring beverage under a first propellant pressure from a supply to a reservoir, withdrawing and dispensing from the reservoir under a second and lesser propellant pressure, and automatically switching from one supply to another as the supplies become emptied.

ON THE DRAWINGS

Figure 2:
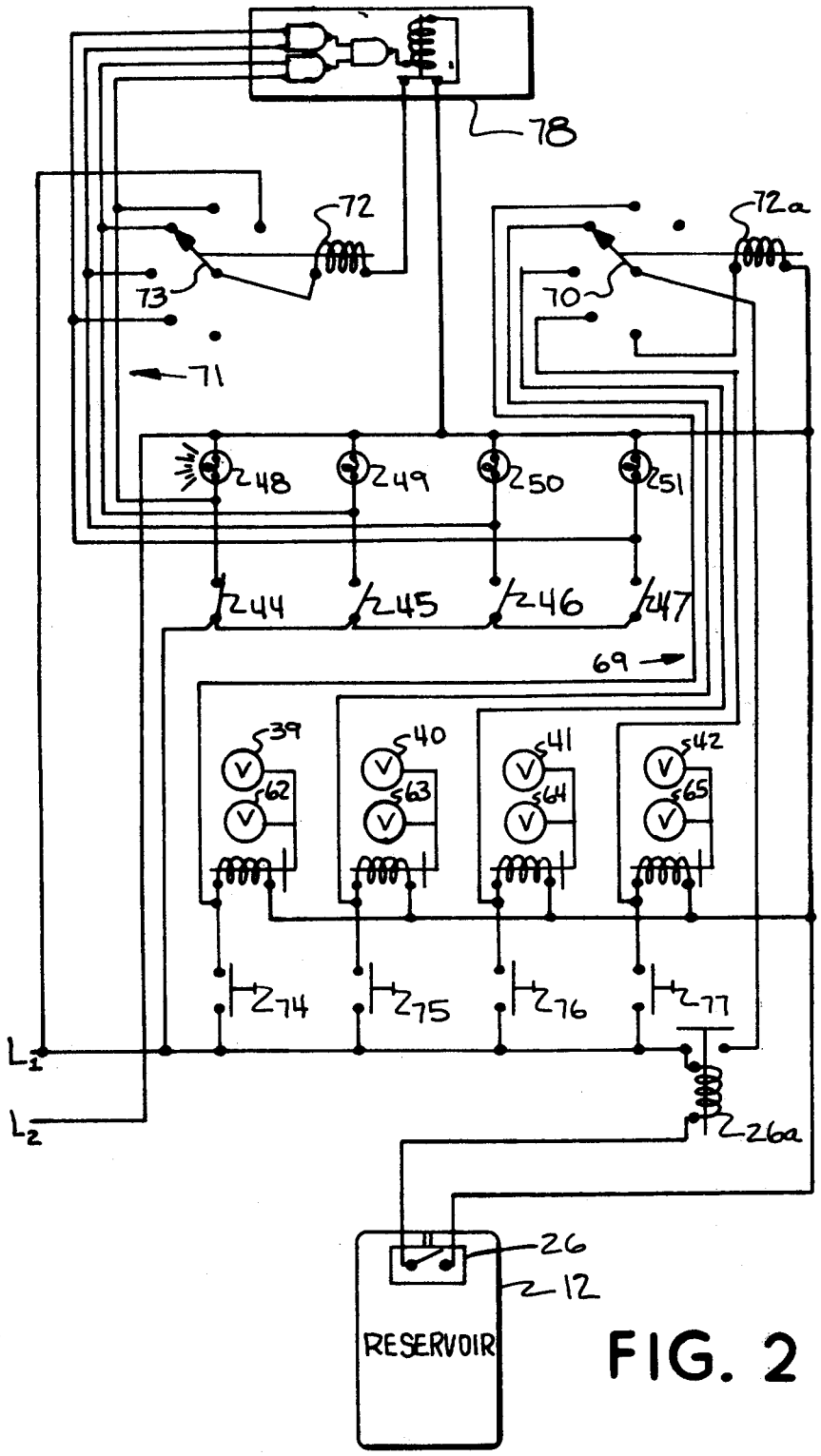

FIG. 1 is a diagrammatic view of a beverage dispensing apparatus provided in accordance with the principles of the present invention showing the beverage and propellant gas systems and a portion of the control circuitry; and FIG. 2 is a diagram of the electrical circuitry utilized in the dispensing apparatus of FIG. 1.

AS SHOWN ON THE DRAWINGS

The principles of the present invention are particularly useful when embodied in an apparatus for dispensing a carbonated beverage of the type illustrated in FIG. 1 and generally indicated by the numeral 10.

The dispensing apparatus 10 includes a dispensing valve 11, a beverage reservoir 12, a beverage supply conduit generally indicated by 13, a propellant gas source 14 and a propellant gas conduit generally indicated by the numeral 15.

The dispensing valve 11 is fluidly connected to the reservoir by a dispensing conduit 16. The dispensing conduit 16 has therein a flow control valve 17 and a normally open shut-off valve 21 which is manually closable. The dispensing valve 11 has an actuator 18 which is operatively connected to be opened by a solenoid 19 and an electric switch 20 is provided for actuating opening of the dispensing valve 11. A portion control 22 operatively interconnects the dispensing valve switch 20 to the dispensing valve solenoid 19 and the portion control 22 is preferably under the control of a cash register (not shown).

An important feature of the beverage dispensing apparatus 10 is the beverage reservoir 12 for storing carbonated beverage ready for dispensing. The reservoir 12 has a beverage inlet 23, a gas inlet 24, a beverage outlet 25 to an upstream portion 25*a* on the dispensing conduit 16, a sensor 26 for sensing the level of beverage within the reservoir 12, and an access cover 27 which is openable for cleaning and providing access to the interior of the reservoir 12.

A beverage supply conduit 13 is provided for connecting the reservoir 12 to pressurized, carbonated beverage supply vessels 28, 29, 30, 31. The supply conduit 13 has a downstream end 32 fluidly connected to the beverage inlet 23 in the reservoir 12. The beverage inlet 23 is the outlet of supply conduit 13. The reservoir 12 has a finite volume and the beverage inlet 23 is placed at a level substantially at the level of one-third of the volume of the reservoir 12. The supply conduit 13 has upstream ends 34, 35, 36, 37 which each have thereon a coupling 38 for connection of the supply conduit 13 to a respective supply vessel 28–31. Each of the upstream ends 34–37 has a normally closed valve 39, 40, 41, 42 for normally precluding flow of carbonated beverage into and through the supply conduit 13. The upstream ends 34–37 are fluidly joined together in a manifold or common portion 43 of conduit 13 which is thence in fluid communication with the downstream end 32 providing common fluid communication between all of the upstream ends 34–37 and the reservoir beverage inlet 23. The upstream ends 34–37 also have sensors 44, 45, 46, 47 respectively for sensing the presence of or absence of beverage in the respective upstream ends 34–37. These sensors 44–47 determine when a respective supply vessel 28–31 is empty by sensing absence of beverage in a respective upstream end 34–37. While the sensors 44–47 shown are of the float type, the use of other types of sensors is well known. Each of the sensors 44–47 is connected to a respective warning light 48, 49, 50, 51 and turns on a respective light for indicating a respective supply vessel is empty.

The propellant gas conduit 15 has a branch line forming a supply vessel propellant gas conduit 52 and another branch line forming a reservoir propellant gas conduit 53. A gas conduit upstream end 54 connects the supply vessel gas conduit 52 and the reservoir gas conduit 53 to the propellant gas source 14 which is a storage tank having an air compressor 14*a* for pressurization thereof.

The reservoir gas conduit 53 has a downstream end 55 fluidly connected to the reservoir gas inlet 24, a pressure regulator valve 56 for controlling the propellant gas pressure within the reservoir 12, a vent 57 for releasing gas from the reservoir 12 while the pressure in the reservoir 12 exceeds a predetermined amount of pressure which is above a predetermined pressure controlled by the regulator 56, and a snifter valve 58 for allowing flow of gas to go in either direction through the reservoir gas conduit 53 but for precluding any flow of beverage foam from the reservoir 12 to the regulator 56.

The supply vessel gas conduit 52 has downstream ends 58, 59, 60, 61 which are also connected to couplings 38 enabling connection of the supply vessel gas conduit 52 to the supply vessels 28–31. Each of the supply vessel gas conduit downstream ends 58–61 has a respective normally closed gas valve 62, 63, 64, 65 therein for normally precluding flow of propellant gas into a respective supply vessel 28–31, and there is a manifold 66 fluidly connecting the downstream ends 58–61 commonly as part of the gas conduit 52. There is a gas pressure regulator 67 in the conduit 52 for controlling gas pressure within the downstream ends 58–61 and therefore also in the supply vessels 28–31. The regulator 67 is set to provide a higher predetermined level of gas pressure in and for the supply vessels 28–31 than a predetermined level of gas pressure in the reservoir 12 as provided and controlled by regulator 56, and the vent 57 relieves at a lesser pressure than the predetermined set pressure of the regulator 67. Specifically, regulator 67 will be set to provide a predetermined 40 PSIG for the supply vessels 28–31, regulator 56 will be set to provide a predetermined 25 PSIG for the reservoir 12, and the vent 57 will release gas from the reservoir at about 30 PSIG.

The supply vessels 28–31 and reservoir 12 are maintained within a refrigeration cooler 68 and preferably at 40° F. (5° C.) or slightly cooler. The pressure of compressed air propellant gas provided for both the reservoir 12 and vessels 28–31 is substantially higher than the carbonation saturation pressure of carbonated beverage within the supply vessels 28–31.

A predetermined quantity of beverage is maintained within the reservoir 12 by the beverage level sensor 26 and the beverage supply valves 39–42. The sensor 26 is a float type device of well known construction, and the sensor 26 is operatively connected to the beverage supply valves 39–42 by a supply circuit generally indicated by the numeral 69. The supply circuit 69 electrically connects the sensor 26 to the beverage supply valves 39–42. A switch 70 selectively connects the sensor 26 to only a selected one of the beverage supply valves 39–42 one at a time. Beverage supply valve 39 and air valve 62, which are both for supply vessel 28, are wired together in parallel for simultaneous operation as are beverage valve 40 and air valve 63, beverage valve 41 and air valve 64, and beverage valve 42 and air valve 65. As illustrated in FIG. 1, the sensor 26 is connected by switch 70 to the valves 40, 63 for supply vessel 29. The sensor 26 is structured to maintain within the reservoir 12 a quantity of beverage substantially equal to two-thirds the volume of the reservoir 12 and therefore to also maintain a quantity of propellant gas equal to one-third the volume of the reservoir 12. The reservoir 12 has nominally been sized to have a total volume of about 19 liters, and the quantity of beverage therein is nominally 12.7 liters and the quantity of gas is 6.3 liters at the pressure within the reservoir 12 as is controlled by the regulator 56.

There are preferably a plurality of dispensing valves like valve 11, the other valves being generally indicated by 11*a*, 11*b*, 11*c*. Each of the additional valves 11*a, b, c*, is identical to dispensing valve 11 and has a flow control, actuator, solenoid switch and individual dispensing conduits 16*a*, 16*b*, 16*c* corresponding to those of dispensing valve 11. The dispensing valves 11, 11*a*, 11*b* and 11*c* are all connected to and are under control of the portion control 22 and each of these dispensing valves may be opened individually or they all may be opened at once for simultaneous dispensing from all of valves 11, 11*a*, 11*b*, 11*c*. The valves 11, 11*a*, 11*b* and 11*c* are usually several hundred meters apart from one another for serving remote and discrete refreshment centers in a large building. The beverage supply conduit 13 is sized to have a greater internal flow area than any combined two of the dispensing conduits 16, 16*a*, 16*b* or 16*c*.

An important feature of the dispensing apparatus 10 is a switching circuit, generally indicated by the numeral 71, for switching operative connection of the sensing means 26 from an emptied supply vessel to a full supply vessel. Four supply vessels 28–31 are shown; there could be as few as two supply vessels or many more than four with which the switching circuit 71 would be useful. As illustrated, vessel 28 is empty, vessel 29 is partially filled and is the vessel being used for refilling reservoir 12, and vessels 30 and 31 are full and vessel 30 will be the next to be used vessel when vessel 29 becomes emptied. The switching circuit 71 connects a stepper motor 72 to the beverage sensors 44, 45, 46, 47 in the beverage supply conduit 13. Within the switching circuit 71 and between the stepper motor 72 and the beverage sensors 44, 45, 46, 47, there is a switch 73 which connects the stepper motor 72 to only one of the beverage sensors 44, 45, 46, 47 at a time. As shown, the switch 73 is connecting the stepper motor 72 to beverage sensor which is for supply vessel 29. The stepper motor 72 is operatively connected to step both switches 70 and 73 together and simultaneously. All of the beverage sensors 44, 45, 46, 47 are connected to a sold-out 78.

There is a manually actuatable primer switch 74, 75, 76, 77 for each of the supply vessels 28–31 respectively. Primer switch 74 is connected to valves 39 and 62; primer switch 75 is connected to valves 40 and 63; primer switch 76 is connected to valves 41 and 64 and primer switch 77 is connected to valves 42 and 65. Each primer switch will open the respective valves to which it is connected.

In the wiring diagram illustrated in FIG. 2, power line $L_1$ is is connected directly to beverage sensors 44, 45, 46 and 47, to primer switches 74–77 and to a normally open reservoir sensor relay 26*a* under the direct control of the beverage level sensor 26 for reservoir 12. When the beverage sensor 26 has relay 26*a* closed, power line $L_1$ is connected to the supply circuit switch 70 and the switch 70 directs power to a proper one of the pairs of beverage supply and gas valves 39,62; 40,63; 41,64; 42,65. The beverage sensors 44, 45, 46 and 47 are normally open and are structured to close when they sense absence of beverage or conversely, the presence of propellant gas, and when closed connect power line $L_1$ directly to empty indicator lights 48–51 respectively, and also connect power line $L_1$ to stepper motor switch 73. The stepper motor switch 73 thence connects power line $L_1$ to the stepper motor 72. The stepper motor 72 includes a reset coil 72*a* for homing the switches 70, 73. All of the beverage sensors 44, 45, 46, 47 are connected to a sold-out 78 through which the stepper motor 72 is connected from $L_1$ to $L_2$.

In operation, the beverage dispensing apparatus 10 will be dispensing a carbonated beverage. The apparatus 10 is specifically suitable and advantageous for the dispensing of beer but is also suitable and advantageous for dispensing carbonated wines or soft drinks. The supply vessels 28–31 will typically be beer kegs of 16 gallons (60 liters) capacity and will be filled with precarbonated beverage and will be pressurized with $CO_2$ gas. It is intended that all of the supply vessels 28–31 have therein the same beverage, specifically the same type and brand of beverage. The supply vessels 28–31 are all fluidly connected to the beverage supply conduit 13 and the propellant gas conduit 15 by the couplings 38. The propellant gas source 14 will have therein a supply of pressurized propellant gas, the preferred propellant gas being compressed air; an alternative preferred gas is a mixture of $CO_2$ and compressed air.

Propellant gas will be provided for each of the supply vessels through the supply vessel gas conduit 52 of the propellant gas conduit 15. The regulator 67 will be pre-set to provide a predetermined pressure of about 40 PSIG (275 kPa) for the supply vessels 28–31. The supply vessels 28–31 as well as the reservoir 12 are maintained at a temperature of about 40° F. (5° C.) by the refrigeration compartment 68 and at this temperature an average beer has a carbonation saturation pressure of about 15 PSIG (105 kPa) and the pressure of the propellant gas applied to the supply vessels 28–31 is greater than the carbonation saturation so that the $CO_2$ in the beverage stays in solution.

Propellant gas will be applied in the reservoir 12 by the reservoir gas conduit 53 of the propellant gas conduit 15. The regulator 56 in the reservoir gas conduit is set to provide a predetermined propellant pressure in the reservoir 12 which is greater than the carbonation saturation pressure of the beverage but less than the predetermined propellant pressure provided in the supply vessels 28–31. Specifically, regulator 56 will provide about 25 PSIG (175 kPa) pressure within the reservoir 12. Beverage is propelled from the supply vessels 28–31 into the reservoir 12 by virtue of the propellant gas pressure in the supply vessels 28–31 being higher than the propellant gas pressure in the reservoir 12.

To transfer beverage into the reservoir 12, it is necessary that the beverage sensors 44, 45, 46, 47 have beverage therein. Actuation of the primer switches 74–77 is used to fill the sensors. Actuation of primer switch 74 opens both beverage supply valve 39 and air supply valve 62 and the supply vessel propellant gas pressure as regulated by regulator 67 will propell any beverage out of supply vessel 28 through beverage supply conduit 13 and into the reservoir 12. When beverage first begins to flow into the beverage supply conduit 13, the upstream end 34 would first be filled, then the beverage sensor 44 would be filled and the beverage would then flow into the manifold or common portion 43, thence into the downstream end 32 and through the beverage supply conduit outlet 23 and into the reservoir 12. The other primer switches operate in similar fashion; primer switch 75 opens valves 40 and 63, primer switch 76 opens valves 41 and 64 and primer switch 77 opens valves 42 and 65 for priming beverage sensors 45, 46 and 47 respectively.

The beverage level sensor 26 in the reservoir 12 is structured to maintain a predetermined quantity of beverage within the reservoir 12. Specifically, the beverage level sensor 26 maintains within the reservoir 12 a quantity of beverage approximately equal to two-thirds the volume of the reservoir and maintains a quantity of propellant gas on and atop of the beverage approximately equal to one-third the volume of the reservoir 12. When the beverage level in the reservoir 12 drops to a normal minimum level below a predetermined average level, the beverage level sensor 26 calls for transfer of beverage from the supply vessels 28–31 into the reservoir 12 and when the beverage level then raises to a normal maximum level above the average level, the beverage level sensor 26 terminates the call for transfer of beverage into the reservoir 12. Beverage is transferred from only one of the supply vessels 28–31 at a time. The supply circuit switch 70 directs a call from the beverage level sensor 26 to only a single pair of beverage supply and gas supply valves and in FIG. 1 the single pair of valves are shown as valves 40 and 63.

When beverage is to be dispensed, the dispensing valve 11 is opened and beverage under the pressure of propellant gas within the reservoir 12 is withdrawn through the beverage dispensing conduit 16 via outlet 25, upstream end 25*a*, shut-off valve 21 and through the flow control 17 and thence out of the dispensing valve 11. Opening and closing of the dispensing valve 11 is controlled by the portion control 22. An operator using the dispensing apparatus 10 will depress the dispensing switch 20 and the portion control 22 will then send a signal to the dispensing solenoid 19 which will move the actuator 18 and open the dispensing valve 18. The portion control 22 effects opening of the dispensing valve 11 for a predetermined period of time. There will be one time period for a glass of beer and another longer period of time for a pitcher of beer. Selection of which time period for which to open the dispensing valve 11 will usually be determined by a cash register (not shown) which would inform the portion control 22 how much beverage to dispense. Operation of the other dispensing valves 11*a*, 11*b* and 11*c* is similar to the operation of dispensing valve 11. The flow control 17 controls the rate of flow of dispensing valve 11 and therefore, for a given time period and a given flow rate a given quantity or volume of beverage will be dispensed. The function of the shut-off valve 21 is to close the dispensing line 16 so that the dispensing valve 11 may be removed, cleaned or sanitized without depressuring the reservoir 12 and for maintaining the other dispensing valve 11*a*, 11*b*, 11*c* in an operative mode while dispensing valve 11 is being serviced.

One of the advantageous features of the dispensing apparatus 10 is that two or more or even all of dispensing valves 11, 11*a*, 11*b* and 11*c* may be open at one time and a plurality of discrete beverage servings may be simultaneously dispensed. The force for propelling beverage from the reservoir 12 and out of the dispensing valves 11, 11*a*, 11*b*, 11*c* comes from the pressure head of propellant gas in the reservoir 12 and the gas regulator 56 can add propellant gas to the reservoir 12 almost as fast as the dispensing valves 11, 11*a*, 11*b*, 11*c* can withdraw beverage from the reservoir 12. The normal quantity of beverage maintained within the reservoir far exceeds the quantity of a plurality of discrete servings that can be drawn at one time and the beverage supply conduit 13, having an internal flow area of at least twice the size of the flow area of any of the dispensing conduits 16, 16*a*, 16*b*, 16*c*, can replace withdrawn beverage in the reservoir 12 at approximately twice the rate any single dispensing valve 11 can withdraw beverage from the reservoir 12. One of the important operative features of the apparatus 10 is that when two or more of the dispensing valves 11, 11*a*, 11*b*, 11*c* are opened, all open valves are drawing beverage originating from only one of the several supply vessels 28–31 rather than one valve drawing from one supply vessel. By virtue of this feature, one supply vessel can be emptied before beverage is withdrawn from a next vessel. Another advantageous feature is that a single supply vessel can supply beverage to a multitude of dispensing valves at one time rather than just one or two dispensing valves.

As beverage is dispensed via any or all of dispensing valves 11, 11*a*, 11*b*, 11*c*, the quantity of beverage within the reservoir 12 will be decreased because all of the beverage supply valves 39, 40, 41 and 42 are normally closed and there normally is no flow of beverage between the supply vessel 28–31 and the reservoir 12. When the level of beverage in the reservoir 12 drops to the predetermined normal minimum level, the beverage level sensor 26 calls for replacement of the withdrawn and dispensed beverage and the supply circuit switch 70 directs the call to a selected one of the supply vessels 28–31. In FIG. 1, the call would be directed to supply vessel 29 because the supply circuit switch 70 is shown directing the call to beverage supply valve 40 and to gas supply valve 63. When the call for transfer of beverage is made, the selected beverage supply valve and gas supply valve such as valves 40 and 63 are both simultaneously opened thereby initiating the step of replacement. When the valves 40 and 63 are open, the supply vessel 29 is in fluid communication with the propellant gas source 14 and propellant flowing through the supply vessel gas conduits enters the supply vessel 29. The supply vessel 29 is in fluid communication with the reservoir 12 as soon as the beverage supply valve 40 is opened and a flow of beverage is transferred through the beverage supply conduit 13 and into the reservoir 12. The beverage being transferred is admitted into the reservoir through the beverage supply conduit 13 at approximately the level of one-third of the volume of the reservoir. Any bubbles of free $CO_2$ or air accompanying the beverage being admitted will go to the top of the reservoir and be separated from the beverage so that no free gas is presented to the reservoir beverage outlet 25. This assures that no free gas will find its way into the dispensing conduits 16, 16*a*, 16*b*, 16*c*, and because the beverage is admitted below the normal minimum level of the beverage within the reservoir 12, there is no spitting, foaming or unnecessary decarbonation at the outlet 23.

As beverage is being transferred into the reservoir 12, the beverage level within the reservoir rises to the maximum normal level and the beverage level sensor 26 terminates the call for transfer of beverage and the respective beverage supply valve and propellant gas supply valve are simultaneously closed. As these valves are closed, further flow of propellant gas into the supply vessel 29 is precluded and further transfer of beverage is precluded as fluid communication between the supply vessel 29 and the reservoir 12 and gas supply 14 is broken. The selected pair of beverage supply valve and gas supply valve such as valves 40 and 63 are opened simultaneously and closed simultaneously so that both valves 40 and 63 are open for the same period of time and when the valves 40 and 63 are closed there can be no flow either into or out from the supply vessel 29.

As beverage is being transferred into the reservoir 12, the gas space atop of the beverage within the reservoir 12 will be reduced in volume and therefore the propellant pressure within the reservoir 12 will rise. The vent 57 is set to open at just slightly above the preset pressure of the regulator 56. Specifically, the vent 57 will open at about 5 PSIG (35 kPa) above the predetermined pressure at which the regulator 56 is set, and when the vent 57 opens, excess propellant gas and $CO_2$ released from beverage will be vented out of reservoir 12 until the pressure within the reservoir drops below the vent close pressure. The snifter 58 precludes any beverage from being vented out of vent 57.

The step of dispensing is repeated at the discretion of the operator of the apparatus 10 and the step of replacing will be automatically repeated in order to maintain the proper level of beverage within the reservoir 12. As these steps are repeated, the supply vessel being drawn from will eventually be emptied of beverage.

Automatic switching from an empty to a full supply vessel is an important feature of the apparatus 10. In FIG. 1, supply vessel 28 is shown as being emptied of beverage; supply vessel 29 is about half full and is the vessel from which beverage would be transferred into reservoir 12; supply vessel 30 is full and will be the next vessel to supply reservoir 12 and supply vessel 31 is also full and will be selected after vessel 30 has been emptied.

When the supply vessel 29 becomes emptied of beverage, the last of the beverage will exit from the vessel 29 via the upstream end 35 of the beverage supply conduit 13 and go through the beverage sensor 45. Propellant gas will follow the beverage into the beverage sensor 45 and when the sensor 45 senses the absence of beverage and presence of propellant gas, the sensor 45 will turn on the warning light 49 to indicate the supply vessel 29 is empty and also sent a signal to switch through the switching circuit 71 to the stepping motor 72. The switching signal energizes the stepper motor 72 and the stepper motor 72 will simultaneously step both switches 73 and 70 to bring supply vessel 30 into use.

The switches 70 and 73 are both stepped CCW as viewed in FIG. 1 stepping of the switch 73 disconnects the stepper motor from the signal from beverage sensor 45 and brings the stepper motor into connection with the beverage sensor 46 for supply vessel 30. As long as the beverage sensor 46 senses the presence of beverage, the stepper motor 72 will not be signaled to step further and the stepper motor 72 will cease operation.

When the beverage supply circuit switch 70 is stepped from the position shown in FIG. 1, both the beverage supply valve 40 and the air supply valve 63 are closed thereby precluding further flow of propellant gas into the supply vessel 29 and from the supply vessel 29 into the upstream end 35 of the beverage supply conduit 13. Almost simultaneously with the disconnection of valves 40 and 63 from the beverage level sensor 26, the supply circuit switch connects the beverage level sensor 26 to beverage supply valve 41 and gas supply valve 64 and these valves 41 and 64 are simultaneously opened bringing supply vessel 30 into immediate fluid communication with both the propellant gas source 14 and the reservoir 12 and beverage will immediately and without interruption begin to transfer from supply vessel 30 into the reservoir 12 because the call from beverage level sensor 26 was continual and uninterrupted and switched almost instantaneously to bring the next supply vessel 30 into operative connection with the reservoir 12. The step of replacement continues uninterrupted and even though it was started with the first supply vessel 29, the replacement step would now be terminated by the closing of beverage supply valve 41 and gas supply valve 64 for the second supply vessel, namely vessel 30. So effective is this switching that an individual drawing beverage from one or more of the dispensing valves 11, **11*a*, 11*b*, 11*c* will not even know it has occurred. Therein is one of the operational features of great advantage, namely one or more and even all of the dispensing valves 11, 11*a*, 11*b*, 11*c* may be open and dispensing beverage from the reservoir 12 during the switching of supply vessels and it will never be apparent that switching was done. When the supply vessel 30 becomes emptied of beverage, the apparatus 10 will switch to supply vessel 31** and so on until all the supply vessels are empty. This switching procedure is very useful when the propellant gas is other than compressed air; the propellant gas could be $CO_2$, $NO_2$, a mixture of air and $CO_2$ or other gas.

If and when all of the supply vessels 28–31 become emptied of beverage, all of the beverage sensors 44, 45, 46 and 47 will be signaling empty to the sold-out 78 and in response thereto the sold-out 78 will disconnect the stepper motor 72 from $L_2$ and the stepper motor will not step either of the switches 70, 73. However, the apparatus 10 is still operative because the reservoir 12 will be about two-thirds filled with beverage. The operator than has a period of time in which to change at least one of the empty vessels. As soon as one of the vessels is replaced and the step of priming is done, the stepper motor 72 will come back on and the switching circuit 71 will find the full tank and then begin transfer therefrom into the reservoir 12.

When the supply vessels 28–31 are emptied of beverage, they must be replaced with new, filled supply vessels. Supply vessel 28 for example is empty and to replace this vessel, the vessel connector 38 is merely disconnected from the supply vessel 28 which also disconnects the upstream end 34 of beverage supply conduit 13 and the downstream end 58 of the propellant gas supply vessel conduit 52 from the supply vessel 28. The dispensing apparatus 10 need not be depressurized or shut off because the beverage supply valve 39 and gas supply valve 62 are both closed and nothing will come out of either conduit 34 or 58. In fact, dispensing can go on uninterrupted from one of the other supply vessels 29–31 and the apparatus 10 will not functionally be aware that supply vessel 28 has been removed.

A new, filled supply vessel is then connected to conduits 34 and 58 using connector 38. When the new vessel is connected, the beverage sensor 44 will still not have beverage therein and will not be operative. In order to make the apparatus 10 be able to transfer beverage from a new supply vessel replacing vessel 28, the primer switch 74 is operated to open beverage supply valve 39 and gas supply valve 62. The propellant gas pressure is applied into the new filled vessel and beverage is forced into the beverage sensor 44. This priming may be done even while the beverage is being transferred from one of the other vessels 29–31 into reservoir 12. Priming can be done simultaneously with dispensing and an operator running the dispensing valves 11, **11*a*, 11*b*, 11*c*** will not even realize the priming is being done.

When the initial prime of beverage is forced into an upstream end 34 of the beverage supply conduit 13, a quantity of air and most likely free $CO_2$ and some foamy beverage will be pushed into and through the beverage supply conduit 13. This gas, free $CO_2$ and foamy beverage may end up in the reservoir 12 during priming or it may not reach the reservoir 12 until the new vessel is called upon for transfer of beverage. Regardless, when the free gas reaches the reservoir 12, it will go to the top of the reservoir and to the extent that the pressure in the reservoir may then open the vent 57, this free gas will be vented out of the reservoir 12 and never reach the dispensing valves 11, **11*a*, 11*b*, 11*c***.

The advantages of the foregoing apparatus 10 and method are many. Nary a drop of beverage is lost, a dispensed portion is of constant liquid volume, the apparatus does not run out of beverage supply during peak draw times, the supply vessels can be changed any time, it can use high pressure for going long distances or great elevations although certain aspects of the apparatus 10 are suitable for use with other propellant gases such as carbon dioxide. The apparatus 10 uses the oldest beer first and only opens one supply vessel at a time.

Although other advantages may be found and realized and various and minor modifications may be suggested by those versed in the art, it should be understood that we wish to embody within the scope of the patent warranted hereon, all such embodiments as reasonably and properly come within the scope of our contribution to the art.

We claim as our invention:

1. Apparatus for dispensing a carbonated beverage comprising:

(a) a source of compressed air;

(b) a reservoir for holding therein a quantity of beverage to be dispensed;

(c) a beverage supply conduit having a downstream end fluidly connected to said reservoir, and an upstream end adapted to be fluidly connected to a supply vessel having carbonated beverage therein;

(d) a compressed air supply conduit having (1) a supply vessel branch line having an upstream end connected to said source of compressed air, and a downstream end adapted to be fluidly connected to said supply vessel for pressurizing beverage within the vessel with compressed air, (2) a reservoir branch line having an upstream end connected to said source of compressed air, and a downstream end fluidly connected to said reservoir for pressurizing beverage within the reservoir with compressed air, and (3) means for regulating air pressure in the reservoir at a lower level of pressure than an air pressure in the supply vessel and at least equal to the carbonation saturation pressure of the beverage within the reservoir;

(e) a dispensing conduit having an upstream end fluidly connected to the reservoir, and a downstream end having thereon means for controlling dispensing of beverage withdrawn from said reservoir and through said dispensing conduit; and (f) a normally closed beverage supply valve in said beverage supply conduit for normally precluding flow of beverage from said supply vessel to said reservoir, said beverage supply valve being selectively openable for permitting flow of beverage from the supply vessel to the reservoir.

2. Apparatus according to claim 1, including a normally closed air valve in said supply vessel branch line for normally precluding flow of compressed air from the source to the supply vessel.

3. Apparatus according to claim 2, including means for simultaneously opening both said beverage supply valve and said air valve.

4. Apparatus according to claim 1, including means for venting compressed air from said reservoir, for maintaining a predetermined air pressure therewithin.

5. Apparatus according to claim 4, including a snifter valve between the venting means and the reservoir, for precluding flow of beverage foam from the reservoir into the venting means.

6. Apparatus according to claim 4, in which said beverage supply conduit has an outlet within the reservoir substantially at the level of one third of the volume of the reservoir.

7. Apparatus according to claim 1, including a plurality of said dispensing conduits, the plurality of dispensing control means being simultaneously operable for the simultaneous withdrawal and dispensing of a plurality of discrete servings of beverage from the reservoir.

8. Apparatus according to claim 7, in which the beverage supply conduit has a passageway for beverage flow of at least twice the area of the passageway for beverage flow in any individual dispensing conduit.

9. Apparatus according to claim 1, including means for sensing the quantity of beverage within the reservoir, and a control circuit operatively connecting said sensing means to said beverage supply valve so that said sensing means will effect opening of said beverage supply valve upon the sensing of less than a predetermined quantity of beverage within the reservoir.

10. Apparatus according to claim 9, in which said beverage supply conduit includes a plurality of said upstream ends with each of said upstream ends having an individual said beverage supply valve therein, said compressed air supply conduit having a like plurality of supply vessel branch line downstream ends, and including means for switching operative connection of said sensing means amongst the plurality of beverage supply valves for sequential emptying of beverage from a plurality of supply vessels.

11. Apparatus according to claim 10, in which each supply vessel compressed air branch line downstream end has a normally closed air valve therein for precluding flow of compressed air into a respective supply vessel, said switching means including means for consequentially switching operative connection of said sensing means amongst the plurality of air valves for sequential application of compressed air upon a plurality of supply vessels.

12. Apparatus according to claim 11, in which said control circuit operatively connects a respective one beverage supply valve and one air valve for simultaneous opening thereof.

13. Apparatus according to claim 1, including means for automatically closing said beverage supply valve upon emptying of said supply vessel.

14. Apparatus according to claim 13, including means for initially priming said beverage supply conduit with beverage from a supply vessel.

15. A method of dispensing a carbonated beverage comprising the steps of:

(a) providing a supply of carbonated beverage;

(b) applying air pressure upon the supply of beverage, said air pressure being at a higher level of pressure than the carbonation saturation pressure of the beverage;

(c) selectively transferring beverage from the supply into a reservoir;

(d) applying air pressure upon the beverage within the reservoir, said reservoir air pressure being at a level of pressure at least equal to the carbonation saturation pressure of the beverage and being at a lower level of pressure than the air pressure upon the supply; and (e) withdrawing beverage from the reservoir and under the reservoir pressure and dispensing the withdrawn beverage for consumption.

16. A method according to claim 15, in which said step of applying air pressure upon the supply of beverage includes selectively connecting the beverage supply fluidly to a source of compressed air for a period of time concurrent with implementation of said step of selectively transferring beverage from the supply to the reservoir.

17. A method according to claim 15, wherein the dispensing step comprises the simultaneous withdrawal and dispensing of a plurality of discrete servings of beverage.

18. A method according to claim 17, including the step of maintaining a predetermined quantity of beverage within the reservoir, said quantity being within a predetermined range.

19. A method according to claim 18, including the step of admitting beverage being transferred into the reservoir at a level below a normal minimum level of beverage within the reservoir.

20. A method according to claim 15, including the step of venting compressed air from the reservoir for maintaining the pressure of the air in the reservoir within a predetermined range of pressure.

21. A method according to claim 20 including the step of venting from the reservoir any compressed air transferred into the reservoir from the supply.

22. A method according to claim 20, including the step of venting from the reservoir any carbon dioxide gas released from the beverage prior to withdrawal of beverage from the reservoir.

23. A method according to claim 15 in which the beverage is transferred from the supply to the reservoir via a reservoir supply conduit, and including the steps of sensing compressed air in the conduit after emptying of the supply, precluding further flow of compressed air into the conduit from the source after said sensing, and switching the reservoir into operative communication with a second supply.

24. A method according to claim 23, including the further steps of disconnecting the emptied supply from the reservoir supply conduit, connecting the second supply to the conduit, transferring air in the conduit into the reservoir ahead of an initial flow of beverage being transferred from the second supply into the reservoir, and venting the thus transferred air from the reservoir.

25. A method according to claim 23, including the step of precluding further application of compressed air upon the emptied supply subsequent to implementation of said step of switching to the second supply.

* * * * *